United States Patent [19]

Voituron et al.

[11] 4,450,125

[45] May 22, 1984

[54] PROCESS FOR THE PRODUCTION OF POLYPROPYLENE FIBRIDS

[75] Inventors: Georges Voituron, Vilvoorde; Jean-Pierre Pleska, Paturages, both of Belgium

[73] Assignee: Solvay & Cie, Brussels, Belgium

[21] Appl. No.: 37,399

[22] Filed: May 7, 1979

[30] Foreign Application Priority Data

May 5, 1978 [FR] France ..... 78 13600

[51] Int. Cl.[3] ..... D21F 11/00

[52] U.S. Cl. ..... 264/13; 264/140

[58] Field of Search ..... 264/13, 140

[56] References Cited

U.S. PATENT DOCUMENTS

| | | | |
|---|---|---|---|
| 3,342,921 | 9/1967 | Brundige et al. | 264/13 |
| 3,770,856 | 11/1973 | Ueki et al. | 264/13 |
| 3,808,091 | 4/1974 | Aoki et al. | 264/13 |
| 3,914,354 | 10/1975 | Ueki et al. | 264/13 |
| 3,987,139 | 10/1976 | Kozlowski et al. | 264/13 |
| 4,010,229 | 7/1977 | Pleska et al. | 264/13 |
| 4,040,856 | 8/1977 | Litzinger | 264/13 |
| 4,054,625 | 10/1977 | Kozlowski et al. | 264/13 |
| 4,183,881 | 1/1980 | Griffin et al. | 264/205 |

FOREIGN PATENT DOCUMENTS 850500 8/1975 Belgium .

*Primary Examiner*—Jay H. Woo
*Attorney, Agent, or Firm*—Spencer & Frank

[57] ABSTRACT

A process for the production of polypropylene fibrids of short length by abrupt expansion of a liquid mixture of molten polypropylene, an alkane solvent for the polypropylene, and a minor amount of a non-solvent for the polypropylene. The mixture, which is at a high temperature and high pressure, is ejected through an expansion orifice to instantaneously vaporize the alkane and to solidify the polypropylene.

17 Claims, No Drawings

PROCESS FOR THE PRODUCTION OF POLYPROPYLENE FIBRIDS

The present invention relates to a process for the production of polypropylene fibrids of short length by abrupt expansion of a liquid mixture which contains molten polypropylene and a predominant amount of alkane and which is at a high pressure and high temperature. The invention relates, also, to the dissolution of a minor amount of a non-solvent for the polypropylene, such as water, in the liquid mixture subjected to abrupt expansion, and to the preparation of polypropylene fibrids which can be employed directly for the manufacture of papers by conventional papermaking techniques.

Various processes which lead directly to the formation of fibrids of short length on abrupt expansion of mixtures of a molten polyolefine and a hydrocarbon solvent have already been developed.

An important advance in the direct production of fibrids of short length, which can be used directly for the production of paper by the conventional papermaking method, was achieved by the development, of the process described in Belgian Pat. No. 824,484 filed on Jan. 17, 1975. This process consists in disturbing the flow of a two-phase mixture at the instant at which it penetrates the orifice of the expansion spinneret.

A process for the manufacture of fibrids of short length has recently been described in U.S. Pat. No. 4,054,625 filed on Aug. 27, 1973 and assigned to Crown Zellerbach Corp. According to this patent, water is added to the mixture of polymer and organic solvent, in such amount that it is present in the form of a dispersed and non-continuous phase in the mixture subjected to expansion. Concentrations of water greater than 10% by volume are preferred and in practice from 40 to 50% by volume of water are used, taking special precautions to ensure the presence of water in the form of a discontinuous dispersed phase. This process suffers from serious disadvantages because it requires the use of large amounts of dispersants, such as polyvinyl alcohol of a high degree of hydrolysis, and the use of large volumes of liquids, which makes the process rather unattractive.

Further, amongst the fibrids of short length, fibrids based on polypropylene are a very valuable material because they impart a very high specific volume to the papers into which they are incorporated. By virtue of the resilience of polypropylene, this very high specific volume is preserved even when the papers are calendered. In addition, these fibrids exhibit excellent drainability. Finally, and above all, polypropylene is currently one of the polyolefines which it is most advantageous to use, especially because of its availability and of its low density.

To produce fibrids of polypropylene by abrupt expansion of liquid mixtures, rather uncommon halogenated solvents such as trichlorotrifluoroethane are generally employed. The use of solvents of this type is considered indispensable if fibrids of good quality are to be obtained. However, it would be more interesting to employ liquid mixtures obtained by heating suspensions of polypropylene particles in a more readily obtainable and less expensive solvent, for example a solvent coming directly from the polymerization process. Unfortunately, the inert solvents which are most advantageously used for the polymerization of propylene are alkanes. Now the liquid mixtures based on polypropylene and alkanes, in particular hexane, give mediocre fibrids under the usual conditions; these fibrids are in the form of agglomerates of coarse texture and cannot be employed by the conventional papermaking method. Fibrids of acceptable structure can only be obtained if the polypropylene concentration is low. However, in that case all the advantages achieved by the use of a relatively economical solvent such as an alkane are more than lost by the disadvantages of the dilution.

In accordance with the present invention, it has now been found possible to employ an alkane as the solvent in liquid mixtures which are concentrated in respect of polypropylene and are subjected to abrupt expansion to produce fibrids of polypropylene, of short length and of very good quality.

The present invention thus relates to a process for the production of polypropylene fibrids by abrupt expansion of a liquid mixture which contains molten polypropylene and a predominant amount of alkane and which is at a high pressure and high temperature, by ejection through an expansion orifice in such a way as to instantaneously vaporize the alkane and to solidify the polypropylene, according to which process a liquid which is a non-solvent for the polypropylene is dissolved in the liquid mixture subjected to expansion.

According to the invention, the liquid mixture subjected to abrupt expansion comprises at least a single liquid phase based on alkane and polypropylene. The mixture can also consist of a system of two liquid phases (a two-phase mixture), namely a continuous phase which is rich in polypropylene, and in which are dispersed droplets of a liquid phase which is poor in polypropylene.

On the other hand, the liquid mixture in general does not contain a substantial amount of a distinct dispersed phase having a predominant content of non-solvent liquid. The non-solvent liquid present in the liquid mixture subjected to the abrupt expansion is preferably present completely dissolved in the organic phase or in the two organic phases. However, the invention does not exclude the possibility that the liquid mixture is brought into contact with a liquid phase having a predominant content of non-solvent liquid, before the abrupt expansion, in order to dissolve the non-solvent liquid in the liquid mixture, for example up to the saturation point. This bringing into contact may employ a continuous phase having a predominant content of non-solvent liquid or may employ a dispersed phase of this type. In the latter case, it is desirable to avoid a situation where the liquid mixture contains droplets of a liquid phase having a predominant content of non-solvent liquid at the instant at which the liquid mixture is about to be subjected to abrupt expansion. To achieve this, the droplets can for example be caused to coalesce and the continuous phase obtained can then be decanted.

The form exhibited by the liquid mixture subjected to abrupt expansion depends on the pressure, the temperature and the polypropylene concentration. In general, it is preferred that the liquid mixture should be in the form of a two-phase mixture, and the pressure, the temperature and the polymer concentration are chosen accordingly. The temperature is in general between 100° and 300° C. and preferably between 125° and 250° C. The polypropylene concentration of the mixture is generally between 1 and 500 g per kg of solvent; it is preferred to employ mixtures containing from 10 to 300 g of polypropylene per kg of solvent, the best results being obtained with concentrations of 50 to 200 g/kg. The pressure applied to the mixture is generally between atmospheric pressure and 100 atmospheres. Preferably, it is between 5 and 80 atmospheres.

Of course the temperature and the pressure must furthermore be selected to be sufficiently high that the expansion of the mixture causes the instantaneous vaporization of the alkane, and to be sufficiently low that the expansion causes the solidification of the polypropylene which the mixture contains.

It is is desired to employ the mixture in the two-phase form, it is often advantageous to subject a mixture which consists of a single liquid phase, and is at a higher pressure, to a pre-expansion. The extent to which this pre-expansion is to take place can easily be determined experimentally, by subjecting to gradual expansion a portion of the mixture which is at a high pressure, and noting the pressure at which the mixture turns cloudy.

All polypropylenes containing at least 50% by weight, and preferably at least 75% by weight, of propylene can be used in accordance with the invention. The best results are obtained if the propylene content is at least 90% by weight and if the polymer is isotactic. The copolymers which can be used include both graft copolymers and block copolymers. The comonomers can be unsubstituted olefines, preferably containing from 2 to 6 carbon atoms in their molecule, or substituted olefines. By way of examples of comonomers there may be mentioned ethylene, butene, butadiene, hexadiene, styrene, vinyl monomers such as vinyl chloride, esters such as methyl acrylate, carboxylic acid anhydrides such as maleic anhydride, and carboxylic acids such as acrylic acid.

In addition to the polypropylene, the liquid mixture can contain small amounts, in general less than 20%, and preferably less than 10%, by weight relative to the polypropylene, of another polymer and more particularly of another polyolefine such as high density or low density polyethylene.

According to an advantageous embodiment of the invention, polypropylenes of low mean molecular weight are used because they make it possible, all other conditions being equal, to increase substantially the concentration of polymer in the mixture subjected to abrupt expansion, without this increase in concentration leading to the production of fibrids of excessive length. The selection of the value of the mean molecular weight will thus essentially be determined by the length of the fibrids which it is desired to obtain, in the light of the fact that higher molecular weights correspond to longer fibrids.

The alkane used according to the invention is generally selected from amongst the acyclic alkanes containing from 4 to 8 carbon atoms in their molecule. Preferably, this alkane is selected from amongst the group consisting of pentane and hexane. The best results have been recorded with n-hexane. The alkane used can be not only a chemically pure product which only contains non-cyclic unsubstituted alkanes, but also a technical product containing at least 50% by weight, and preferably at least 80% by weight, of such alkanes. Amongst these products, the best results are obtained with the hexanes containing at least 90% by weight of non-cyclic unsubstituted alkanes having 6 carbon atoms.

According to the invention, a non-solvent liquid is dissolved in the liquid mixture subjected to abrupt expansion. The term "non-solvent" is intended to designate any substance which is liquid under the conditions prevailing at the instant at which the mixture is about to be subjected to abrupt expansion and which does not substantially dissolve the polypropylene present in the composition of the liquid mixture. Preferably, a non-solvent liquid which is incapable of dissolving more than 1% by weight of polypropylene under these conditions is selected. The non-solvent liquid can be an organic or inorganic compound and is preferably a polar compound.

By way of organic compounds which can be used there may be mentioned the aliphatic alcohols, such as methanol, the halogenated hydrocarbons, such as methylene chloride, and the aldehydes, such as acetaldehyde.

By way of inorganic compounds, water may be mentioned. The latter constitutes the preferred non-solvent liquid for carrying out the process according to the invention. In effect, water is not only inexpensive but is also preferably compatible with the subsequent paper making processing, of the fibrids obtained. Furthermore, its subsequent separation from the alkane, for example in order to recycle the latter to the polymerization reactor, does not present any particular problem.

The amount of non-solvent liquid dissolved, according to the invention, in the liquid mixture can be less than the solubility of the liquid in the mixture. It is preferred that at the instant at which the mixture is about to be subjected to abrupt expansion the amount of non-solvent liquid dissolved in the mixture should be more than 50% of its solubility. The best results are obtained if this amount is equal to the solubility.

Though it is desirable to avoid the presence of the non-solvent liquid as a distinct phase, having a predominant content of non-solvent liquid, in the liquid mixture subjected to abrupt expansion, a small amount of non-solvent liquid present in this form does not interfere greatly. In general, conditions are chosen so that this amount should not exceed about five times the solubility in the liquid mixture under the conditions prevailing at the instant of the abrupt expansion. Preferably, this amount is less than about twice the solubility. The best results are obtained when this amount is zero.

If water is used, the amount of water present is in general between 0.5 and 10% by weight relative to the weight of alkane, and most frequently between 1 and 5%.

The best results have been recorded in the case where the liquid mixtures contain from 5 to 15% by weight of polypropylene, and technical-grade hexane to which about 2.5% by weight of water has been added.

The conditions under which the non-solvent liquid is added to the mixture are selected so as not to favor the formation of an additional dispersed phase of this liquid in the alkane. Thus, if the process is carried out discontinuously and the non-solvent liquid is present in excess, relative to its solubility in the alkane, it is desirable that the mixture should not be agitated, so as not to interfere with good phase separation; if the process is carried out continuously, it is desirable not to exceed the threshold of miscibility of the non-solvent liquid with the alkane.

The instant at which the non-solvent liquid is added to the mixture is not critical. It can be incorporated into the mixture when the principal constituents are brought together. For reasons of convenience it is however preferred to incorporate the non-solvent liquid when the mixture of polypropylene and alkane already is liquid, and more particularly when it is in a single-phase form.

When the process according to the invention is combined with a process of manufacture of the polypropylene in suspension in the alkane employed in the composition of the mixture, the non-solvent liquid can, for example, be added when the suspension from the reactor has been converted to a solution. Any device can be used for incorporating the non-solvent liquid into the mixture. Advantageously, the device may be a metering pump.

In addition to the polypropylene, the alkane and the non-solvent liquid, the liquid mixture can contain usual additives for polypropylenes, such as antioxidants, light stabilisers, antistatic agents, surface-active agents, reinforcing agents, fillers, pigments, dyestuffs and nucleating agents, provided that these do not interfere with the formation of the mixture, the instantaneous vaporisation of the solvent, and the solidification of the polypropylene.

It is also possible to pretreat the polypropylene in a known manner by oxidation before putting it into use. Finally, the liquid mixture can also contain a polar monomer which can be grafted onto the polypropylene so as to improve the compatability of the fibrids obtained with a cellulose pulp where the fibrids are to be used in the manufacture of mixed papers. In such cases, the liquid mixture then also contains a source of free radicals in addition to the polar monomer to bring about the grafting reaction in the actual mixture, before the abrupt expansion.

During the abrupt expansion, the pressure applied to the mixture is brought back to a value close to atmospheric pressure, preferably to an absolute pressure of less than 3 kg/cm$^2$, within a very short period of time, preferably of less than 1 second. This expansion is achieved by passing the mixture through an orifice, which is preferably cylindrical and has a diameter of between 0.1 and 20 mm, preferably between 0.5 and 10 mm, and a length/diameter ratio of between 0.1 and 10 and preferably between 0.5 and 2.

According to a preferred embodiment of the process according to the invention, this abrupt expansion is achieved in accordance with the process, and by means of the device, described in detail in the aforementioned Belgian Pat. No. 824,484.

According to this process, the stream of mixture which flows towards the inlet of the expansion orifice is disturbed just before penetrating the orifice, preferably by deflecting a part of the stream of mixture, upstream of the expansion orifice, in such a way that this part penetrates the said orifice along a direction which forms an angle with the axis of the orifice.

A preferred device for carrying out this process comprises a spinneret possessing a disturbance chamber equipped with at least one feed orifice and one expansion orifice opposite thereto, the ratio of the distance between the orifices to the lateral dimension being less than 5.

The texture of the fibrids obtained in accordance with the process of the invention is further substantially improved if steps are taken, in the course of carrying out the process, to lubricate the walls of the expansion orifice by a continuous flow of a film of a liquid which is incompatible with the mixture formed at the inlet of the expansion orfice.

The liquid lubricant employed in the process according to this variant can be of any type, provided that it is incompatible with the liquid mixture, that is to say, provided that it forms a continuous phase distinct from this mixture, and in particular provided it does not dissolve the polypropylene present in the mixture. This lubricant is preferably heated to a temperature close to the temperature of the liquid mixture before being fed onto the wall of the expansion orifice.

For reasons of simplicity it is preferred that the lubricant used should be of the same nature as the non-solvent liquid dissolved in the liquid mixture. The particularly preferred lubricant is water, for the same reasons that the latter is preferred as the non-solvent liquid. Furthermore, water makes it possible to obtain fibrids having a texture of remarkable quality. In addition, the short fibrids produced in this way are very easily suspended in water. Finally, during the production of the fibrids the water vaporises and forms a sheath which envelops the stream of fibrids and prevents the latter from becoming stuck to the hot parts of the expansion spinneret.

The liquid lubricant is introduced at a flow rate of between 30 and 250 liters/hour and preferably of between 40 and 150 liters/hour when using special devices described below, of which the expansion orifice has a diameter of the order of 1 mm.

The polypropylene fibrids obtained by the process according to the invention are of excellent quality and can be used in all applications of this type of material and especially for producing completely synthetic or mixed papers by conventional papermaking methods.

The process according to the invention is illustrated by the practical embodiments which follow and which are given purely by way of illustration and do not in any way limit the scope of the invention.

EXAMPLE 1

(Comparative)

A two-phase mixture is produced by bringing a mixture comprising 10% by weight of polypropylene having a melt flow index of 5 and 90% by weight of technical-grade hexane sold by ESSO under the name ESSO D.A. polymerization grade, to a temperature of 205° C. and a pressure of 70 bars.

This mixture is expanded by passing it through a spinneret having a disturbance chamber, as described herein and as described more fully in Belgian Pat. No. 824,484 particularly in relation to FIG. 13 of this patent.

The divergent portion which extends the abrupt expansion orifice has a 150° opening.

The two-phase mixture is fed in at the rate of 15 kg of polymer/hour.

The fibrids obtained are evaluated by determining their lengths by screening, their maximum length and their maximum diameter. The evaluation of the fibrids by screening is carried out by means of a Bauer-Mac Nett screening apparatus, in accordance with standard specification TAPPI, No. T 233. The fibrids obtained have the following characteristics:

(1) Bauer-Mac Nett screening apparatus

| Screen No. | % of fibres retained |
|---|---|
| 14 | 31 |
| 25 | 39 |
| 50 | 25 |
| 100 | 3 |
| 200 | 2 |

(2) Maximum length: 7.5 mm (3) Maximum diameter: 230 microns

It is thus found that a high percentage of fibres is retained on the screen having the largest mesh size.

Furthermore, these fibres and long and coarse. They cannot be used as the starting material for processing by conventional papermaking techniques.

EXAMPLE 2

Example 1 is repeated except that 6% by weight of water is added to the technical-grade hexane. The water not dissolved in the liquid mixture is removed by decanting.

The evaluation of the fibrids obtained gave the following results:

(1) Bauer-Mac Nett screening apparatus

| Screen No. | % of fibres retained |
|---|---|
| 14 | 0.6 |
| 25 | 5 |
| 50 | 56 |
| 100 | 22 |
| 200 | 12 |

(2) Maximum length: 4.6 mm (3) Maximum diameter: 70 microns

It is thus found that the fibrids obtained no longer form a coarse agglomerate, because there are very few of them which are retained on the screens having the largest mesh size; furthermore, the fibrids are shorter and finer. They are perfectly suitable for processing by papermaking techniques.

EXAMPLE 3

Example 2 is repeated, additionally injecting into the disturbance chamber of the spinneret shown in FIG. 13 of Belgian Pat. No. 824,484 water at 205° C. under a pressure of 62 bars, at a rate of 60 liters/hour.

The two-phase mixture is fed in at the rate of 182 liters/hour; the fibrids obtained have the following characteristics:

(1) Bauer-Mac Nett screening apparatus

| Screen No. | % of fibres retained |
|---|---|
| 14 | 0.3 |
| 25 | 3 |
| 50 | 54 |
| 100 | 24 |
| 200 | 13 |

(2) Maximum length: 3.4 mm (3) Maximum diameter: 60 microns

It is thus found that the lubrication of the spinneret by the same non-solvent liquid as that added to the mixture subjected to abrupt expansion further improves the texture of the fibrids obtained.

EXAMPLE 4

(Comparative)

Example 3 is repeated, but without adding water to the technical-grade hexane; the fibrids obtained have the following properties:

(1) Bauer-Mac Nett screening apparatus

| Screen No. | % of fibres retained |
|---|---|
| 14 | 8 |
| 25 | 29 |
| 50 | 48 |
| 100 | 10 |

-continued

| Screen No. | % of fibres retained |
|---|---|
| 200 | 4 |

(2) Maximum length: 5.8 mm (3) Maximum diameter: 140 microns

It is thus found that the lubrication of the spinneret alone does not suffice to obtain fibrids of a satisfactory texture from a mixture of molten propylene and technical-grade hexane.

EXAMPLE 5

Example 3 is repeated, except that 5% by weight of methanol is added to the technical-grade hexane. Furthermore, the mixture is brought to a pressure of 85 bars.

The fibrids obtained have the following characteristics:

(1) Bauer-Mac Nett screening apparatus

| Screen No. | % of fibres retained |
|---|---|
| 14 | 2 |
| 25 | 10 |
| 50 | 50 |
| 100 | 22 |
| 200 | 12 |

(2) Maximum length: 3.6 mm (3) Specific surface area: 6 $m^2/g$

We claim:

1. A process for the production of polypropylene fibrids by abrupt expansion of a liquid mixture which contains molten polypropylene and a predominant amount of alkane and which is at a high pressure and high temperature, by ejecting the liquid mixture through an expansion orifice to instantaneously vaporize the alkane and to solidify the polypropylene, which comprises:

forming a liquid mixture comprised of said molten polypropylene, said alkane solvent for the polypropylene and a minor amount of a liquid which is a non-solvent for the polypropylene, said non-solvent liquid being dissolved in the liquid mixture, and wherein the amount of said non-solvent liquid which is present in said liquid mixture in the form of a distinct phase having a predominant content of non-solvent liquid is a zero amount; and abruptly expanding said liquid mixture containing said non-solvent liquid by ejection through said expansion orifice to instantaneously vaporize said alkane and to solidify said polypropylene.

2. The process according to claim 1, wherein said non-solvent liquid is water.

3. The process according to claim 1, wherein said non-solvent liquid is dissolved in said liquid mixture in an amount equal to at least 50% of the solubility of said non-solvent liquid therein.

4. The process according to claim 2, wherein said non-solvent liquid is dissolved in said liquid mixture in an amount equal to at least 50% of the solubility of said non-solvent liquid therein.

5. The process according to claim 1, wherein the expansion orifice is lubricated with a film of liquid incompatible with said liquid mixture.

6. The process according to claim 2, wherein the expansion orifice is lubricated with a film of liquid incompatible with said liquid mixture.

7. The process according to claim 1, wherein said molten polypropylene comprises a polypropylene containing at least 75% by weight of propylene.

8. The process according to claim 2, wherein said molten polypropylene comprises a polypropylene containing at least 75% by weight of propylene.

9. The process according to claim 1, wherein said alkane is selected from the group consisting of acyclic alkanes containing from 4 to 8 carbon atoms in their molecule.

10. The process according to claim 2, wherein said alkane is selected from the group consisting of acyclic alkanes containing from 4 to 8 carbon atoms in their molecule.

11. The process according to claim 3, wherein said alkane is selected from the group consisting of acyclic alkanes containing from 4 to 8 carbon atoms in their molecule.

12. The process according to claim 7, wherein said alkane is selected from the group consisting of acyclic alkanes containing from 4 to 8 carbon atoms in their molecule.

13. The process according to claim 1, wherein said alkane is selected from the group consisting of pentane and hexane.

14. The process according to claim 2, wherein said alkane is selected from the group consisting of pentane and hexane.

15. The process according to claim 3, wherein said alkane is selected from the group consisting of pentane and hexane.

16. The process according to claim 1, wherein said polypropylene comprises a polypropylene containing at least 90% by weight of propylene, wherein said alkane solvent comprises hexane containing at least 90% by weight of unsubstituted acyclic alkanes containing 6 carbon atoms, and wherein said liquid mixture is saturated with water.

17. The process according to claim 16, wherein said liquid mixture contains about 2.5% by weight of water relative to said hexane.

* * * * *